US005600986A

United States Patent [19]

Ishikawa et al.

[11] Patent Number: 5,600,986

[45] Date of Patent: Feb. 11, 1997

[54] SIZING PRESS AND DIE SYSTEM

[75] Inventors: Takashi Ishikawa; Takao Yunde; Shigefumi Katsura; Toshisada Takechi, all of Chiba, Japan

[73] Assignee: Kawasaki Steel Corporation, Kobe, Japan

[21] Appl. No.: 254,233

[22] Filed: Jun. 6, 1994

[30] Foreign Application Priority Data

Jun. 7, 1993 [JP] Japan ..... 5-136128

[51] Int. Cl.[6] ..... B21B 15/00

[52] U.S. Cl. ..... 72/206; 72/416; 72/442

[58] Field of Search ..... 72/416, 206, 442

[56] References Cited

FOREIGN PATENT DOCUMENTS

| | | | |
|---|---|---|---|
| 63-180301 | 7/1988 | Japan | 72/206 |
| 63-192503 | 8/1988 | Japan | 72/416 |
| 1-284402 | 11/1989 | Japan | 72/416 |
| 1-284406 | 11/1989 | Japan | 72/416 |
| 2-6003 | 1/1990 | Japan | 72/442 |
| 4-4901 | 1/1992 | Japan | 72/416 |
| 4-100601 | 4/1992 | Japan | 72/416 |
| 515908 | 1/1993 | Japan | 72/416 |
| 5-15908 | 6/1993 | Japan | 72/416 |
| 5-146807 | 6/1993 | Japan | 72/416 |

*Primary Examiner*—David Jones
*Attorney, Agent, or Firm*—Dvorak and Traub

[57] ABSTRACT

In a sizing press for reducing by pressure width of hot slabs of both a low carbon steel and a stainless steel, the reduction by pressure of width is performed quickly without replacing the dies each time. Two or more types of dies having caliber configurations for respectively reducing the width at least of a low carbon steel and a stainless steel are disposed in layers and are retained in a manner capable of being displaced in an up and down direction. They may be replaced as a block with another block of stacked dies.

6 Claims, 5 Drawing Sheets

SIZING PRESS AND DIE SYSTEM

FIELD OF THE INVENTION

1. Field of the Invention

The present invention relates to a sizing press for hot rolling, a method of changing die thereof, a die change system and a method of measuring distance in a die. More particularly, the present invention relates to a sizing press and a die change system for use in hot rolling of two or more types of slabs that are different in their hot rolling characteristics.

2. Description of the Related Art

Having regard to a die arrangement in a sizing press for continuously reducing the width of hot slab by pressure, Japanese Patent Laid-Open No. 61-202705 discloses an arrangement in layers consisting of a pair of main press dies having a sloped chamfer portion toward the inlet side and a parallel portion extending from the sloped chamfer portion toward the outlet side in the direction along which the hot slab is conveyed. Further disclosed is a rear end preforming die having a sloped portion spread out toward the outlet side from the inlet side in the conveying direction of the hot slab.

Considering the lifetime of the main die, Japanese Patent Laid-Open No. 2-6003, for example, discloses a 3-layer structure including a rear-end preforming die, where the main dies are arranged into two layers. These techniques, however, do not consider the configuration of die caliber, i.e., these are the techniques basically premising a flat shape for the caliber configuration.

Also, there is a problem in changing of a die in the sizing press. In a sizing press such as disclosed in Japanese Patent Laid-Open No. 60-96301, the die for performing reduction in width by pressure has a relatively short lifetime because it is exposed to high temperature and high pressure. In a hot rolling mill for a steel, its lifetime generally ends after reducing width of about one hundred pieces of slab. To achieve a longer lifetime of such die, Japanese Patent Laid-Open No. 62-282738 discloses a method in which the thermal load is reduced by moving the die in an up and down direction. This is, however, not quite satisfactory. In a large-scale hot strip mill, lifetime of the die is completed in one day or so after which it must be changed. Change of the die in the sizing press must be performed during operation. Therefore, in addition to minimizing the time required for die change, there is a great desire for reducing as much as possible or completely eliminating, operation to be performed by the operator at the time of changing the die in a mill which is operated by the minimum number of persons. In the conventional art, a die-change system is disposed, for example, above the sizing press. The worn die is pulled upward from the sizing press and it is then moved horizontally. A ground and shaped up die which has been set in the die-change system is positioned above the sizing press and die change is effected by dropping the ground die into the apparatus. According to such system, the die change may be performed while stopping the mill for a relatively short time period (5 minutes for example). However, replacing of the die pulled up to a position above the sizing press with the next required die must be performed by an operator by means of a crane.

Moreover, in addition to the need for change due to lifetime of the die as described, needs have recently arisen for using optimal dies according to slab section or steel type. It is increasingly necessary to perform more frequently die changes in comparison to the conventional requirement. For example, while the seam that occurs in the vicinity of edges in the width direction has been a problem in a stainless steel, it is known as an example of proper use of dies according to steel type, that such seam may be reduced by optimizing the die configuration at the time of reducing the width by pressure. It is desirable to use for stainless steel, a die which is different in shape from a die for a low-carbon steel. In order to meet the needs for production of a great variety of products in small lots, the chances of rolling a special material such as a stainless steel tend to be dispersed. A system presupposing die changes at a high frequency is increasingly necessary.

Also, since surface damage on the die occurs in a sizing press, the die is removed and ground by a grinder again every time after a predetermined period of use. In order to assure accuracy in the material sheet width after reduction, the gap in a die is currently actually measured on-line to effect a width adjustment.

In view of the above, it is an object of the present invention to improve die arrangement in a sizing press and to solve the following various problems related to the same.

(1) On rolling stainless steels, side surface of the slab should be shaped up to form a concave shape to avoid edge seam problem.

(2) On the other hand, on rolling low carbon steels, side surface of the slab should be shaped up to form a flat surface. In other words, there has been a problem in the conventional art that the die must be changed for the respective width reductions of a stainless steel and a low carbon steel.

Because of the above, in the case where a stainless steel and a low carbon steel are to be alternately reduced in width by pressure, a steel type must be processed in a bulk to minimize changing the die. The reason for this is that a die change generally requires several minutes.

In addition to the above problems, problems that cannot be coped with by a flat die now occurs also in a low carbon steel. From the viewpoint of energy saving, the slab heating temperature has become lower. A local temperature drop occurs on the slab ridge after passing the width press to cause $\gamma \rightarrow \alpha$ transformation, where a fall-in type of flaw occurs due to difference in deforming behavior between the $\gamma$-region and the $\alpha$-region. It has been found that, for a low carbon steel, the slab ridge portion must be pressed by means of a press die so as to prevent a local temperature drop on the slab ridge portion. Accordingly, dies should be changed when hot rolling temperature has been changed, on rolling low carbon steels only.

(3) Work load for die change is reduced by achieving a construction in which a large number of types of dies may be changed at once. In the case of a hot strip line, the conventional die-change system is disposed above a sizing press as high as several meters above the ground. Although a working deck for the operator is provided, it is necessary to perform preparations for the conveying operation at an elevated location while vibration being caused due to the width reduction by pressure. Setting of a die to the die-change system is difficult and requires experience. Safety, too, is a problem.

(4) As types of dies increase and the die is to be changed more frequently, increasing of the number of setting positions of the dies may be considered in a die-change system which is disposed above the sizing press. However, since a set of dies weighs 10 to 20 tons, this is not economical because the facility must be increased in size to dispose a large number of dies at a position several meters above the ground.

(5) In the conventional method for actually measuring on-line the distance in the die of a sizing press, a person must enter the gap between the halves of a die to effect the measurement. This causes a problem of safety. Further, since time is required in the die change and the width measurement, lowering of the operating ratio of the system, too, was a problem. Especially in the case where a plurality of dies are arranged in an up and down direction to use them alternately in order to cope with various material sheet thickness and steel types, a long time is required as width measurement must be effected for the same number of times as the number of dies.

SUMMARY OF THE INVENTION

It is an object of the present invention to provide a sizing press by which the above problems may be solved, to provide a die-change technique matching the same and to provide a method for safely measuring the distance in a die.

To solve the above problems, the present invention comprises the following technical means.

(A) In a sizing press for reducing by pressure the width of hot slabs respectively of two or more types of steels, for example, a low carbon steel and a stainless steel, that are different in their hot rolling characteristics, the sizing press according to the present invention is characterized in that at least a plurality of pairs of press main dies are disposed in layers and there are two or more types of caliber configuration of the main dies. In the present invention, a "main die" refers to a die which has a sloped chamfer portion toward the inlet side and a parallel portion from the sloped chamfer portion toward the outlet side in the conveying direction of the hot slab. This is distinguished from a rear end preforming die which consists of a sloped portion spread out toward the outlet side from the inlet side in the conveying direction of the hot slab. Preferably, the caliber configurations of the main dies in the above sizing press are a caliber configuration for pressing the slab ridge portion and a caliber configuration for forming the slab side surface into a recessed shape.

(B) In die change of the above described sizing press, the present invention provides a die-change method in which the dies are pulled upward from the sizing press as a block consisting of the dies disposed in layers and they are replaced at once by a die block consisting of dies in layers which have been ground. A die-change system according to the present invention for suitably implementing this method comprises: a structure extended sideward from a position above the sizing press; and a lifting apparatus placed on the structure and traveling horizontally along said structure while lifting a die block consisting of dies disposed in layers. This system pulls the worn dies as an entire die block having the dies in layers upward from the sizing press and then it mounts onto the sizing press a new die block (a ground die block) which is held ready above the sizing press. Thereafter, the used up die block is conveyed horizontally and the used die block is replaced by a ground die block on aground platform car which is provided on the floor level.

(C) Further, in accordance with a third aspect of the present invention, a method for measuring the gap in a die is provided, in which a laser beam is used at the time of changing a press die in a sizing press to automatically measure the distance between the left and right halves of the die through an on-line system.

DETAILED DESCRIPTION OF THE INVENTION

Figure 1A:
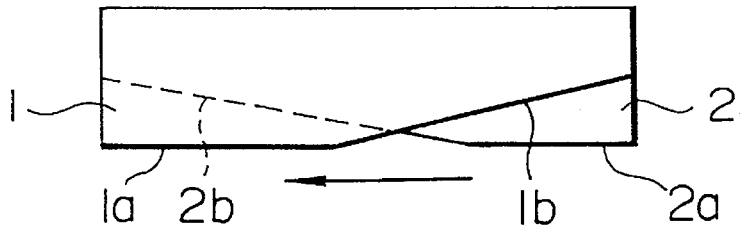
FIG. 1A is a top view showing an attaching arrangement of dies according to an embodiment of the present invention.

Conventionally, only a longer lifetime and a front and rear end preforming function have been required as the objective function of the die in a sizing press. On the contrary, in the present invention, the caliber configuration of the die side surface is optimized according to the characteristics of the material and needs, so that the respective material is reduced in width by means of a die having an optimal caliber configuration. An example will now be described with respect to the case where a stainless steel and a low carbon steel are used as the material.

In the case of a stainless steel, the function required for a sizing press die is to form the slab side surface into a recessed shape so as to reduce the fall-in amount of the edge seam. In the case of a low carbon steel, on the other hand, it is desirable to provide a die capable of working on the slab ridge portion so that a localized cooling of the slab ridge portion will not occur even if it is extracted at a relatively low temperature. In other words, the function required of a sizing press die differs according to the material.

Further, in a hot strip mill for rolling a stainless steel and a low carbon steel in the same mill, it is desirable from the viewpoint of production control not to limit the rolling chance of these steel types because of the performance of the sizing press. For example, it is in some cases necessary to alternate the rolling chances respectively of a stainless steel and a low carbon steel. In that case, die change must be performed as smoothly as possible.

In other words, for the sizing press which alternately reduces the widths respectively of a stainless steel and a low carbon steel, there is provided a very effective method in which two types (two types of caliber configuration) or more of the above described main dies are provided. These are set in layers so that the dies different in caliber configuration from each other are moved vertically and are used properly according to the material.

Further, in the case of effecting a crop control which is a conventional technique, in addition to the main die, a preforming (such as a rear end preforming) die is necessary for each different type of steel. In such a case, it is necessary to place dies in layers consisting of four stages of: (a) a main die for a low carbon steel; (b) a rear end preforming die for a low carbon steel; (c) a main die for a stainless steel; and (d) a rear end preforming die for a stainless steel. Dies may be provided in two or more stages of any number. Further, from the viewpoint of preforming requirement and of the lifetime of the die, the dies to be layered upon each other are not necessarily of different types. Two identical dies may be placed in layers.

The die-change method of the present invention will now be described. According to the present invention, dies are replaced as a block consisting of stacked dies. The worn dies are automatically conveyed to the floor level. Accordingly, preparation for the conveying operation at a high place becomes unnecessary. The preparation for the conveying operation on the ground is performed less frequently by providing some quantity of stock on the ground-level platform car. Also, since this is not an operation above the sizing press, it is not necessary that the operator of the mill performs the preparation for the conveying operation. This is suitable for an automated mill which is operated by a small number of persons. Further, it is possible to convey only those necessary dies from the ground platform car (storage yard for dies) to the change system above the sizing press to set them in position. Even when the number of types of die is increased, it is not necessary to provide a larger scale supporting structure of the change system above the sizing press. It suffices to support dies corresponding to two sets consisting of a die block to be set next and a worn die block. It should be noted that flexible measures may be taken even when number of types of die to used is increased.

In the method for measuring the gap in a die according to the present invention, after mounting a re-machined die onto the press body, the opening/closing of the die is effected by using a width adjusting drive device of the sizing press. Laser beams for confirming the position of the die are directed in parallel to the die. While operated widthwise, the die comes to shield the laser at some point. By recognizing such position, the position widthwise of the die may be obtained. In the case where the dies are placed in layers upon another, laser beams corresponding to the number of stages are provided, so that the positions widthwise of all the dies may be recognized by one widthwise moving operation.

DESCRIPTION OF THE PREFERRED EMBODIMENTS

EXAMPLE 1

Figure 1B:
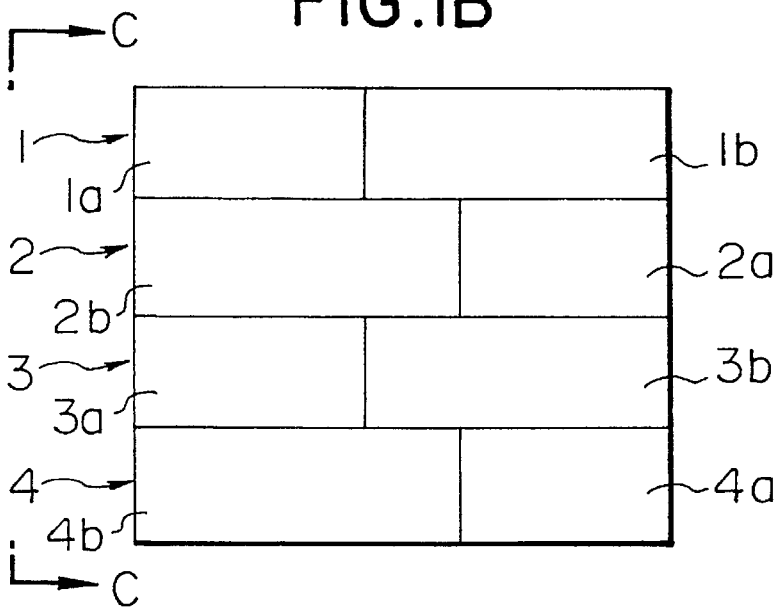
FIG. 1B is a front view showing an attaching arrangement of dies according to an embodiment of the present invention.
Figure 1C:
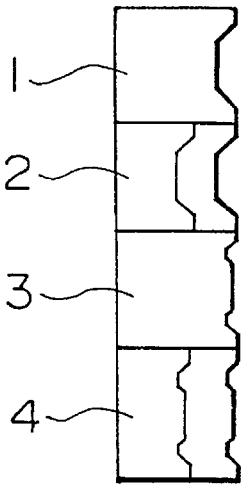
FIG. 1C is a side view showing an attaching arrangement of dies according to an embodiment of the present invention.

In a hot strip mill, a low carbon steel has a slab thickness of 260 mm and a stainless steel has a slab thickness of 200 mm. Dies are arranged in four stages, as shown in FIG. 1, and consisting of a main die 1 for the common steel, a rear end preforming die 2 for the common steel, a main die 3 for the stainless steel, and a rear end preforming die 4 for the stainless steel.

Figure 2:
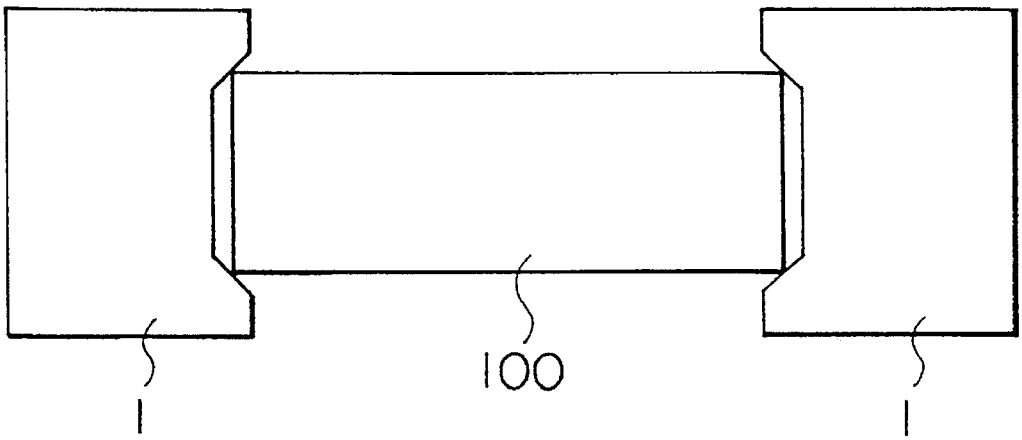
FIG. 2 shows a caliber configuration of a die for reducing width of a low carbon steel.
Figure 3:
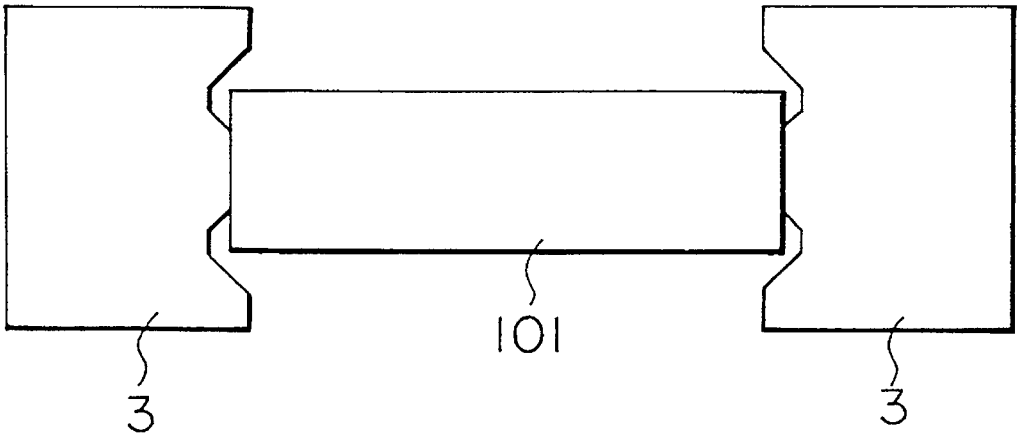
FIG. 3 shows a caliber configuration of a die for reducing width of a stainless steel.

A caliber configuration as shown in FIG. 2 is used as the die 1 for the common steel 100, while a caliber configuration as shown in FIG. 3 is used as the die for the stainless steel 101. The stainless steel 101 and the common steel 100 are alternately rolled. In reducing width of the common steel, the common steel main die 1 and the common steel rear end preforming die 2 are used to perform preforming of the front and rear ends and reduction of width based on the conventional art. In pressing the stainless steel, the dies are moved in an up and down direction for example by means of drive of a hydraulic cylinder, so as to use the stainless steel main die 3 and the stainless steel rear end preforming die 4 to perform preforming of the front and rear ends and width reduction. Since traveling time in the up and down direction of the dies is several seconds, it will not hinder production.

Figure 4:
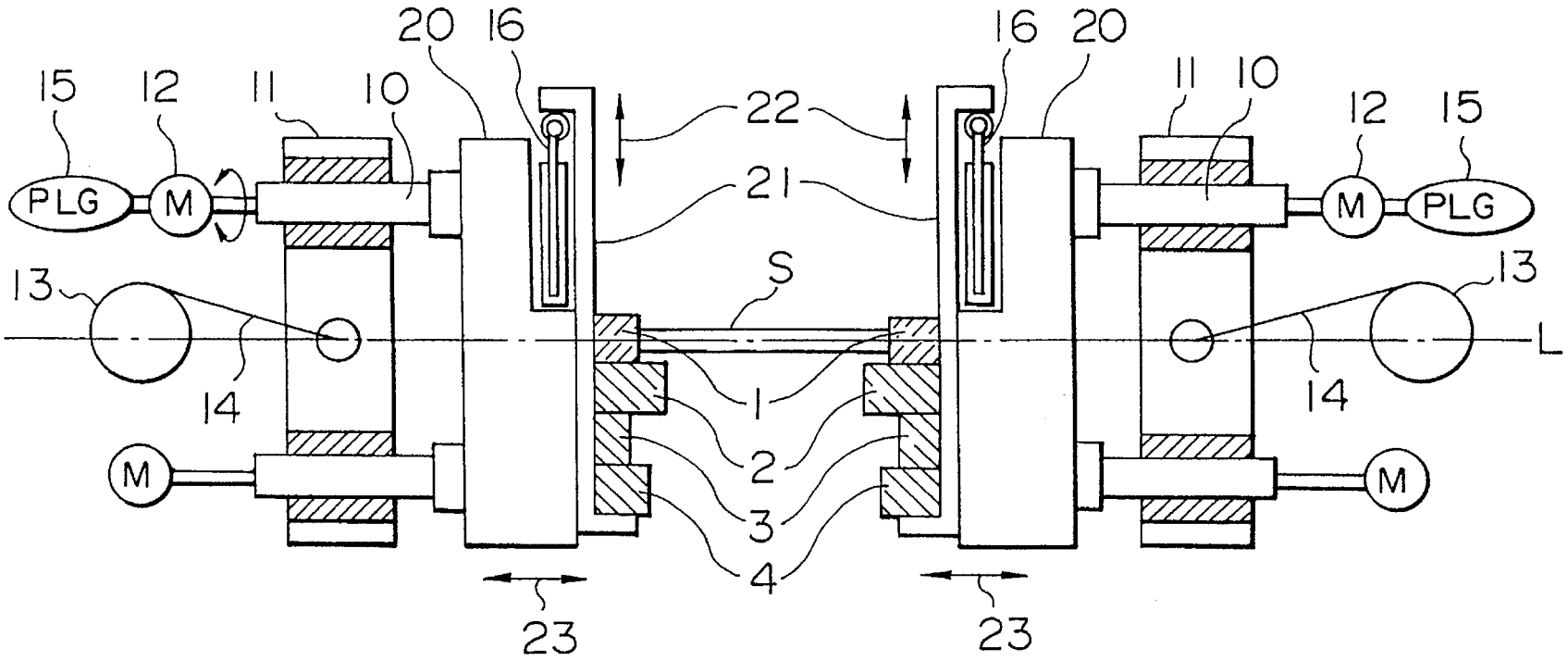
FIG. 4 is a cross sectional view of a sizing press according to an embodiment of the present invention.
Figure 5:
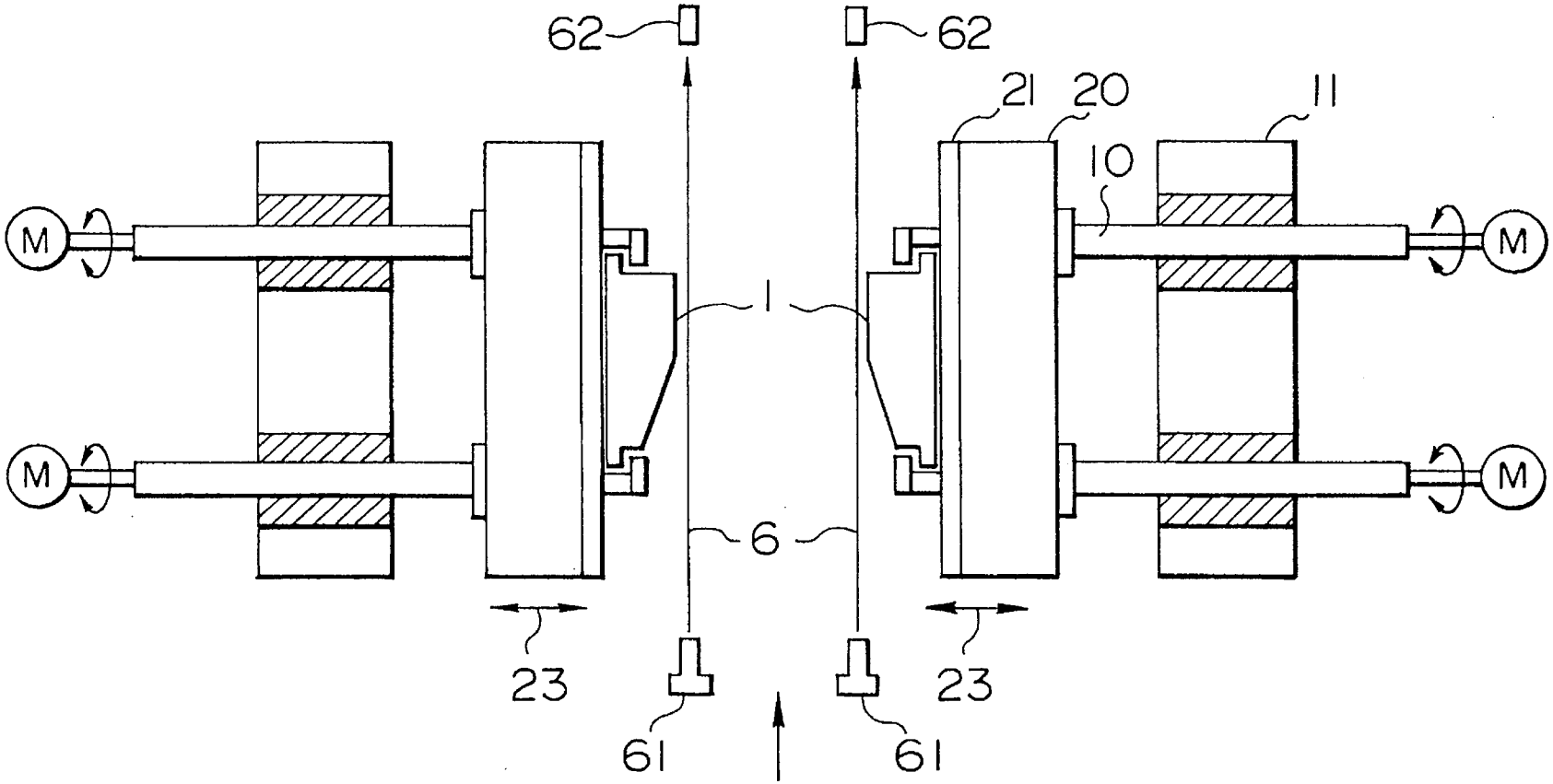
FIG. 5 is a top view corresponding to FIG. 4.

FIG. 4 is a cross sectional view of the main portions of a sizing press showing an embodiment of the present invention. FIG. 5 is a corresponding top view. Dies 1~4 are mounted on a die slider 21 as shown in FIGS. 4 and 5. In the example shown in FIG. 4, the dies 1, 2, 3, 4 are mounted in four stages in an up and down direction. In the figures, S denotes a slab and L denotes the conveying level of the material to be rolled.

The left and right halves of each die are adjusted to the same level and are used as a pair. In other words, the die slider 21 is moved up and down by using a die shift cylinder 16 to select a die which will be adjusted to the conveying level L for use.

Figure 6:
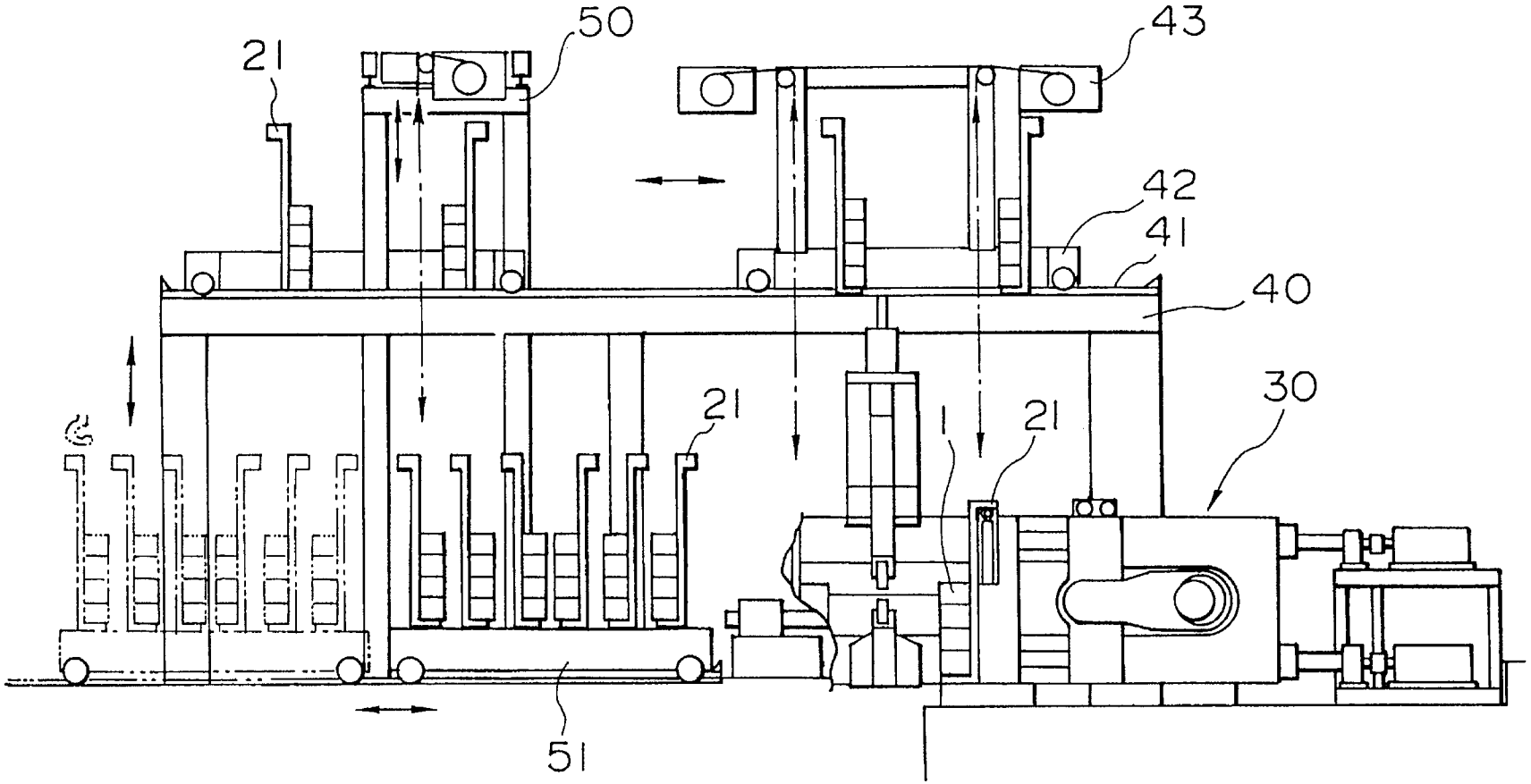
FIG. 6 is a side view of the whole of the die change system.

In changing the dies, the die slider 21 and the dies 1~4 are integrally lifted upward to be moved away and then new dies are set together with the die slider and are mounted. The removed dies are carried to another place in a manner as shown in FIG. 6, where they are machined again. At this time, since the extent of damage of each of the dies 1~4 differs from that of another, they are different from each other in the respective amount to be re-machined. For this reason, difference in thickness of the dies results as shown in FIG. 4.

A width adjusting device is provided in order to adjust the respective dies in accordance with a sheet width. That is, the gap in each die is adjusted such that a screw 10 is rotated by driving a motor M which is fixed on a base, so as to move the slider 21 in a front and rear direction through a block 20.

The sizing press operation (reducing by pressure of width, adjusting of width) is performed such that a crank shaft 13 is rotated by a motor (not shown), so as to cause an integrated forward and rearward movement through a connecting rod 14 of a body block 11, the screw 10, the slider 21 and the dies 1~4. At this time, adjustment in the amount of the reduction by pressure of width is performed by position adjustment of the crank shaft.

Laser emitting devices 61 and receiving devices 62 are installed as shown in FIG. 5, so that laser beams 6 are passed in paths parallel to the length direction of the dies. After mounting the re-machined dies 1~4 together with the die slider 21 onto the body block 20, a width adjusting motor M (12) is rotated in the state where the laser beams are emitted. Each timing at which a laser beam is shielded by a die is detected by a width recognizing revolution meter PLG. It is thereby possible to readily obtain the respective reference surface of the dies which are different in the amount by which they are machined again. Based on this, the die position may be adjusted in accordance with a material sheet width.

EXAMPLE 2

In a sizing press 30 shown in FIG.6, dies 1, . . . are mounted on a die attaching block die slider 21. When changing the dies, the dies are pulled out upward as a block together with the die slider 21 by a die-change system. The die-change system comprises: a structure 40 provided in a manner extended sideward from a position above the sizing press 30; a rail 41 provided on the structure 40; a changing platform car 42 traveling along the rail 41; a lifting device 43 placed on the changing platform car 42; and a loading/unloading device 50 which lifts the slider 20 from a ground level platform car 51 and replaces it with another on the changing platform car 42. The changing platform car 42 is moved along the rail 41 so that the ground dies set on the loading/unloading device 50 are loaded onto the changing platform car 42 by the loading/unloading device 50. The changing platform car 42 is returned to its position above the sizing press to set the die slider 21 in a manner of dropping it into the sizing press body 30.

The on-line changing platform car 42 on which the pulled out, worn dies are placed is moved furthermore widthwise to the position under the loading/unloading device 50 which is provided for replacing them with those on the ground level platform car. The loading/unloading device 50 lowers the worn dies onto the ground level platform car 51 in a manner of suspending them.

Upon receiving of the worn dies by the ground level platform car 51, dies to be loaded next onto the changing platform car 42 are set to a position directly under the loading/unloading device 50 by shifting the ground level platform car 51 so that they may be lifted. The changing platform car 42 may be shifted to set the next dies on the changing platform car 42.

The structure enabling the functions of lowering worn dies to the floor level in the sizing press body and of setting the floor level ground dies onto a die changing device above the sizing press body, is not limited to that of the embodiment as described above.

According to the present invention, edge seam may be reduced for a stainless steel and a fall-in flaw may be eliminated of a low carbon steel. Furthermore, in an endless rolling or the like, a stainless steel and a low carbon steel may be alternately reduced in width quickly without requiring replacing of the dies with others.

Further, the work of an operator may be reduced and die change may be achieved with greater safety. Furthermore, die change at a high frequency using a large number of dies has become possible even in a mill which is operated by a small number of persons.

Moreover, since width adjustment of the dies may be automatically effected, the distance between the right and left halves of a die may be measured safely and quickly. In addition, positions respectively of the left and right sides from the center line may be accurately detected. This is a help in improving the sheet width accuracy. A deforming of the sheet such as a transverse warpage, too, may be prevented.

What is claimed is:

1. A sizing press for reducing the width of hot slabs of one of a low carbon steel and a stainless steel, comprising:

a stack of main press dies of at least two types of caliber configurations;

a die slider on which said main press dies are mounted;

a die shift cylinder for selectively driving said die slider and said stack of main press dies in an up and down direction relative to said hot slabs to be reduced;

a block mounted on said press to which said die slider and said die shift cylinder are attached, said block being reciprocately movable in a widthwise direction for reducing said hot slabs under pressure of said main dies;

a changing platform car which reciprocately moves between a position above said sizing press and an off-line position of said sizing press for exchanging said die slider for a new die slider;

a lifting device mounted on said changing platform car for lifting said die slider from said press to a level above said sizing press and for lowering said new die slider into said press; and a loading/unloading device associated with said press at said off-line position for exchanging die sliders on said changing platform car.

2. The sizing press according to claim 1, wherein the caliber of said main press die for low carbon steel is so configured so as to roll a slab ridge portion, while the caliber of said main press die for stainless steel is so configured as to recess a slab side surface.

3. The sizing press according to claim 1, wherein said block is movable by a widthwise rolling actuator which includes an electric motor, a crankshaft driven by said electric motor and a connecting rod driven by said crankshaft so as to drive said block.

4. The sizing press according to claim 1, wherein said stack of main press dies comprises a plurality of left and right matching die halves.

5. The sizing press according to claim 4, further comprising recognizing means for recognizing the positions of said matching left and right die halves.

6. The sizing press according to claim 5, wherein said recognizing means includes a laser transmitter and a laser receiver arranged such that a laser beam runs in parallel with said matching left and right dies.

* * * * *